United States Patent [19]

Hofmann, Jr.

[11] 4,089,625

[45] May 16, 1978

[54] ROTARY GAS MACHINE

[75] Inventor: Rudolf Hofmann, Jr., Deidenbergen, Germany

[73] Assignee: Comprotek, S. A., Munich, Germany

[21] Appl. No.: 642,609

[22] Filed: Dec. 19, 1975

[30] Foreign Application Priority Data

| | | |
|---|---|---|
| Dec. 21, 1974 | Germany | 2460752 |
| Jul. 14, 1975 | Germany | 2531385 |
| Jul. 14, 1975 | Germany | 2531415 |
| Jul. 22, 1975 | Germany | 2532751 |

[51] Int. Cl.[2] ..... F01C 1/10; F01C 11/00; F01C 19/04; F01C 21/00

[52] U.S. Cl. ..... 417/440; 418/9; 418/97; 418/126; 418/127; 418/169; 418/83; 418/178

[58] Field of Search ..... 418/9, 97, 126–129, 418/168–170, 201, 203; 417/440

[56] References Cited

U.S. PATENT DOCUMENTS

| | | | |
|---|---|---|---|
| 724,665 | 4/1903 | Cooley | 418/168 |
| 1,496,737 | 6/1924 | Petersen | 418/169 |
| 1,531,904 | 3/1925 | Dinesen | 418/169 |
| 1,689,673 | 10/1928 | Lalor | 418/9 |
| 1,719,640 | 7/1929 | Wilsey | 418/169 |
| 1,768,818 | 7/1930 | Bock | 418/170 |
| 1,773,211 | 8/1930 | Wilsey | 418/9 |
| 1,904,284 | 4/1933 | Fagan et al. | 418/169 |
| 2,124,377 | 7/1938 | Schirmer | 418/169 |
| 2,287,716 | 6/1942 | Whitfield | 418/201 |
| 2,349,022 | 5/1944 | Ungar et al. | 418/201 |
| 2,691,482 | 10/1954 | Ungar | 418/9 |
| 2,740,386 | 4/1956 | Crandall | 418/168 |
| 2,998,783 | 9/1961 | Lee | 418/169 |
| 3,136,261 | 6/1964 | Eckerle et al. | 418/169 |
| 3,179,330 | 4/1965 | MacColl | 418/201 |
| 3,279,682 | 10/1966 | Vagenius | 418/9 |
| 3,443,522 | 5/1969 | Schindler | 418/169 |
| 3,448,615 | 6/1969 | Schneider, Jr. | 418/169 |
| 3,482,446 | 12/1969 | Wrinkle et al. | 418/169 |
| 3,890,066 | 6/1975 | Eckerle | 418/169 |
| 3,910,731 | 10/1975 | Persson et al. | 418/97 |

*Primary Examiner*—John J. Vrablik

*Attorney, Agent, or Firm*—Wegner, Stellman, McCord, Wiles & Wood

[57] ABSTRACT

A rotary gas compressor or expansion motor with a housing having circumferentially spaced inlet and outlet ports. An outer cage or sleeve rotor has alternate slots and teeth. An inner lobe rotor has lobes which mesh with the slots of the cage rotor as the two rotate. The space between the two rotors is filled with a crescent-shaped housing member. The slots, teeth and lobes of the rotors are helical.

60 Claims, 27 Drawing Figures

FIG. 14
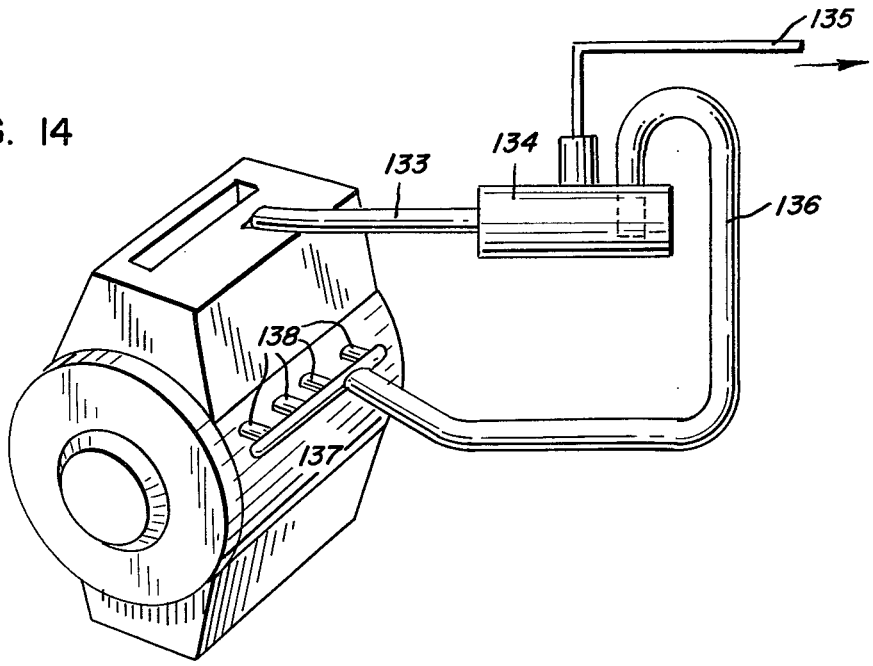
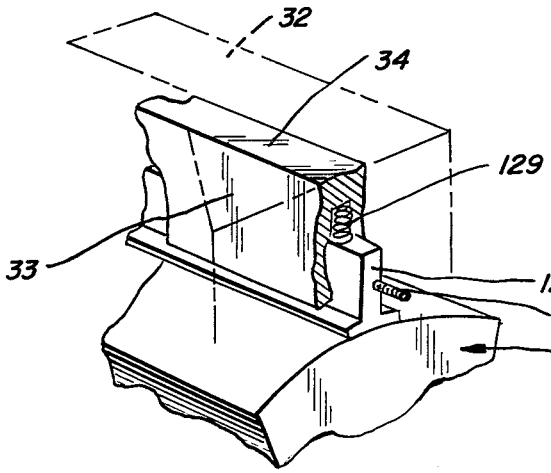
FIG. 13
FIG. 12
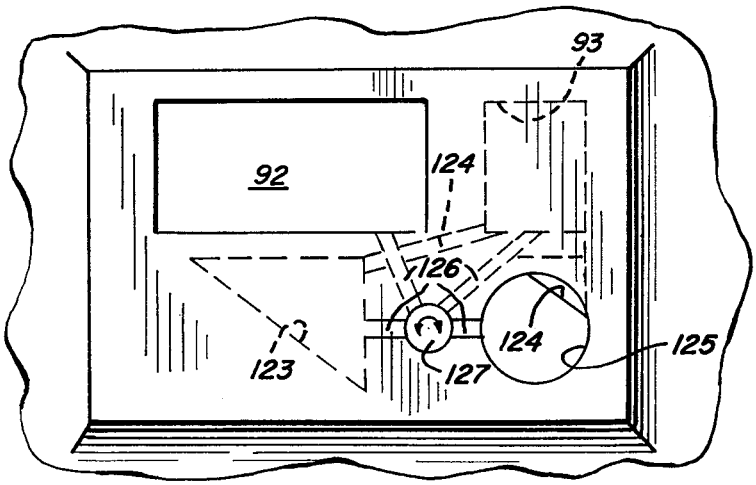

ROTARY GAS MACHINE

This invention is concerned with an expansible chamber rotary gas machine having two rotors with intermeshing peripheral surfaces. The outer rotor is a cage or sleeve with alternate teeth and slots. The inner rotor is smaller than the cage and has lobes which mesh with the slots of the sleeve. An outer housing has circumferentially spaced low pressure and high pressure ports. A crescent-shaped inner housing member fills the space between the rotors opposite the zone along which they mesh.

The basic construction is known. See, for example, Dinesen U.S. Pat. No. 1,515,192 and Bock U.S. Pat. No. 1,768,818. Both are concerned with liquid pumps rather than gas compressors. Eyer U.S. Pat. No. 3,810,721 illustrates a similar construction used in a compressor.

A principal object of the present invention is the provision of an efficient, reliable and versatile gas compressor or expansion motor utilizing dual meshed rotors.

A major feature of the invention is the provision of such an expansible chamber gas machine having helical teeth and slots in the cage rotor and helical lobes on the lobe rotor. The lobes of the lobe rotor mesh with the slots of the cage rotor as the rotors turn, with the outer peripheries of the rotors being substantially tangent along a sealing line between the low pressure and high pressure ports. The crest of the lobe of the lobe rotor moves axially along the slot of the cage rotor at the tangent or sealing line.

The basic machine construction may be utilized either in a compressor or in a gas expansion motor. Many of the features of the specific machine illustrated herein are particularly suited for and advantageous in a compressor. Accordingly, much of the description will be in terms of the operation of the machine as a compressor. It is to be understood that the invention and the claims are not limited to a compressor unless expressly so stated.

Another feature is that the high pressure port, e.g., the outlet for discharging compressed air in a compressor, has the configuration of a right triangle with the hypotenuse parallel with the helix of the rotors, one leg parallel with the sealing line and the other leg at right angles thereto.

A further feature is that the lobes of the lobe rotor have peripheral edges which seal with the side wall surfaces of the teeth of the cage rotor.

Yet another feature is that the diameter of the cage rotor is twice that of the lobe rotor, the cage rotor has twice as many slots and teeth as the lobe rotor has lobes, and the lobe rotor rotates at twice the angular velocity of the cage rotor. With this configuration, the side wall surfaces of the teeth of the cage rotor are radial with respect to the center of the cage rotor. The lobe rotor for such a cage rotor has lobes with flanks that have a surface configuration defined by a cycloid, with the center hub of the lobe rotor having a circular periphery joining the cycloids at either side thereof.

A further feature of the invention is that the cage rotor has a ring gear secured thereto and a spur gear engaged with the ring gear drives the lobe rotor in synchronism with the cage rotor. The ring gear extends into a sump for lubricating oil and provides a part of the means for delivering oil from the sump to the rotor bearings.

Still another feature is that the machine operating as a compressor has two compression stages with the cage rotor having two axially spaced sets of teeth and slots and the lobe rotor two axially spaced sets of lobes which mesh with the slots of the cage rotors, and the high pressure port for one set of rotors is connected with the low pressure port for the other set of rotors to provide two stage compression. A further feature of the two stage compressor is the inclusion of a bypass valve interconnecting the high pressure port of the second stage with the low pressure intake port of the first stage to select compressor capacity.

And another feature is the provision of a sealing element between the outer housing and the rotors along the line of tangency of the rotors. In one form of machine means are provided for axially moving the sealing element, providing a bypass from the high pressure port to the low pressure port.

Yet a further feature is the provision of means for cooling the machine, as by circulating a fluid through the inner housing member or through the lobe rotor.

Another feature is the provision of a layer of sealing material on the surfaces of the cage rotor which bound the spaces in which gas is under pressure. More specifically, sealing surfaces are provided on the walls of the teeth of the cage rotor and on the outer and inner peripheral surfaces. Typically, the sealing material may be a soft metal alloy or a plastic.

Yet a further feature is that the periphery of the lobe rotor intersects the periphery of the cage rotor along the line of tangency to provide an arcuate surface across which the rotors are sealed with the housing.

Further features and advantages of the invention will readily be apparent from the following specification and from the drawings, in which:

FIG. 12 is a fragmentary plan view of the ports and bypass valving of a two stage compressor;

FIG. 13 is a fragmentary perspective view illustrating an axial sealing element for the machine;

FIG. 14 is a diagrammatic illustration of a machine with provision for injecting a cooling liquid;

Figure 1:
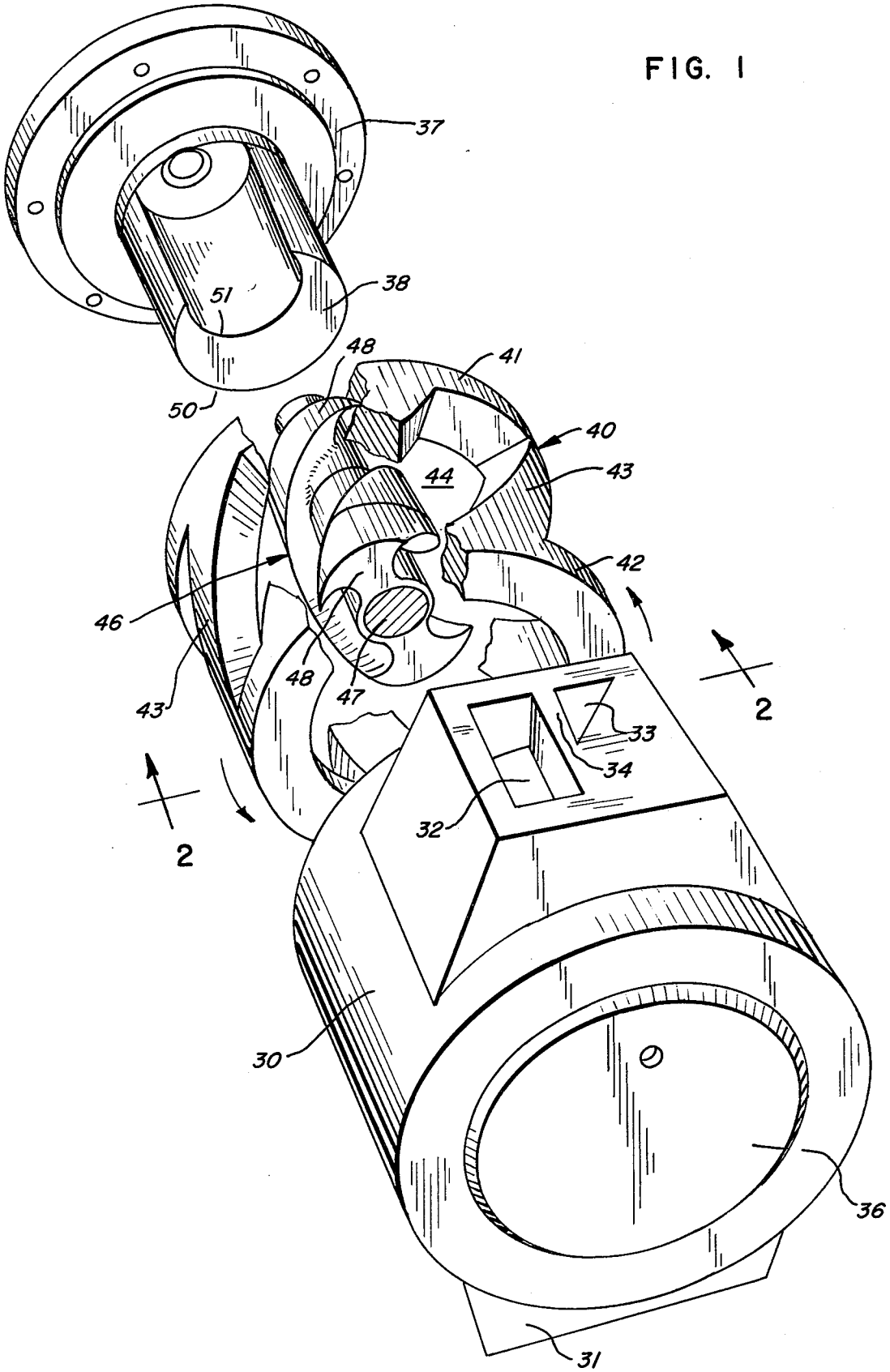
FIG. 1 is an exploded diagrammatic view illustrating the invention.

The rotary gas machine disclosed herein utilizing meshing cage and lobe rotors may be manufactured with smaller clearances and thus better seals than a comparable rotary screw machine. This enables operation at a lower speed resulting in longer life for the bearings. The injection of oil to provide a seal is in many machines unnecessary, greatly simplifying auxiliary equipment used with the machine.

The helical chambers and lobes or pistons afford certain advantages over machines of the prior art with straight slots and lobes. For example, in a compressor a higher compression ratio and a continuous flow of compressed gas may be achieved. Additional desirable characteristics of the machine will be described below.

Turning now to FIGS. 1 through 4, one form of the machine is illustrated. A cylindrical outer housing 30 has a base 31 and low pressure and high pressure ports 32 and 33, respectively, spaced peripherally on the surface and separated by an axial wall 34. One end of cylindrical outer housing member 30 is closed by end plate 36 and the other by end plate 37. A crescent-shaped inner housing member 38 is mounted on end plate 37 and extends axially within the outer housing member to end plate 36.

Cage rotor 40 is a cylindrical member which fits inside cylindrical outer housing member 30 and between the outer housing and the crescent-shaped inner housing member 38. The cage rotor has a pair of end rings 41, 42 joined by a plurality of peripherally spaced teeth or webs 43 which extend between the end rings and are spaced angularly apart to define a plurality of slots or working chambers 44. Teeth 43 and slots 44 extend helically from one end of the cage rotor 42 to the other.

A lobe rotor 46 has a central shaft 47 and a plurality of helical lobes 48 which mesh with the slots 44 of the cage rotor.

The outer surface of cage rotor 40 seals with the inner surface of the cylindrical outer housing member 30 while the inner surface of the cage rotor seals with the outer or major arc surface of inner housing member 38. Lobe rotor 46 has its axis parallel with the axis of the cage rotor and in a radial plane extending through outer housing wall 34 between the ports 32, 33. The periphery of lobes 48 of the lobe rotor seal with the minor arc 51 of the inner housing member and with the inner surface of the outer housing member along an axial tangent line between the two rotors at housing wall 34. The edges of the lobes 48 seal with the axial walls of the cage rotor webs 43 bounding the portion of slot 44 in which gas is compressed or expands.

The machine operates as a compressor if the rotors are driven in a counterclockwise direction as viewed in FIG. 1. Air is drawn in at low pressure port 32, compressed by the meshing of lobe 48 with working space 44 and discharged under pressure through high pressure port 33. Conversely, the machine operates as an expansion motor with the rotors turning in a clockwise direction if gas under pressure is supplied to the high pressure port 33. Most of the following discussion treats the machine as a compressor, for air, a refrigerant or the like, to simplify the operating description. Many of the features to be discussed are equally applicable to an expansion motor and operation of the machine in this manner will be understood.

An infinite variety of combinations of cage and lobe rotors in terms of relative diameter, the number of webs 43 and working spaces 44 and of lobes 48 may be selected. In the machine illustrated, the diameter of the cage rotor is twice the diameter of the lobe rotor. The cage rotor has four working spaces 44 and webs 43. The lobe rotor has two lobes 48. The angular velocity of the lobe rotor is twice that of the cage rotor. The minor arc 51 of the inner housing member 38 passes through the center 53 of the cage rotor. The center 54 of the lobe rotor is located in the radial plane through housing wall 34 and is spaced from cage rotor center 53 by the radius of the lobe rotor. The teeth 43 and working chambers 44 are equal in angular extent, each having an arc of $\pi/4$.

Figure 2:
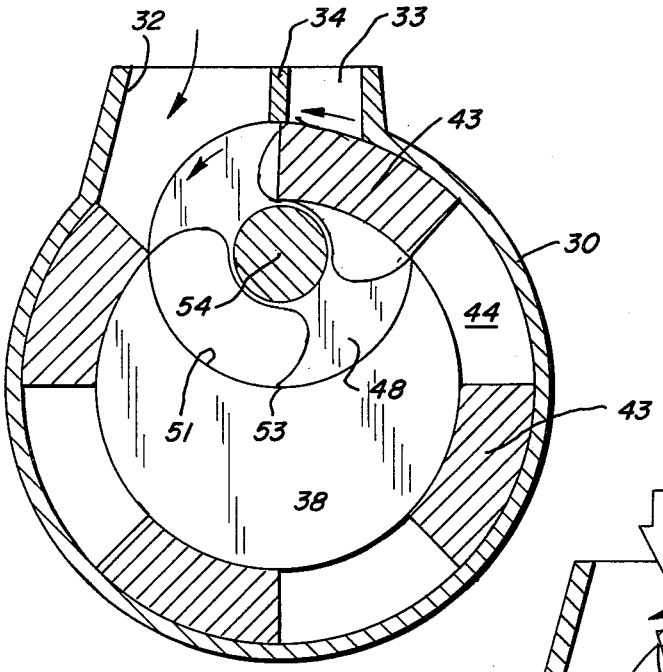
FIGS. 2, 3 and 4 are a series of sections taken generally along line 2—2 of FIG. 1 illustrating three successive positions of the rotors.
Figure 3:
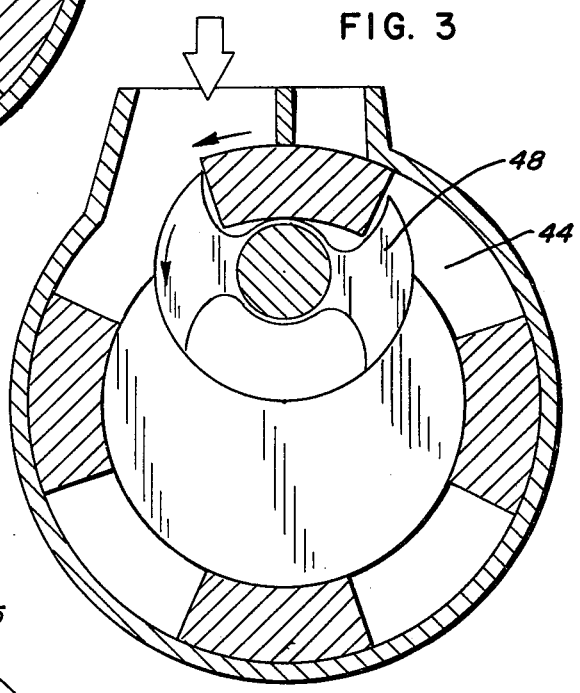
Figure 4:
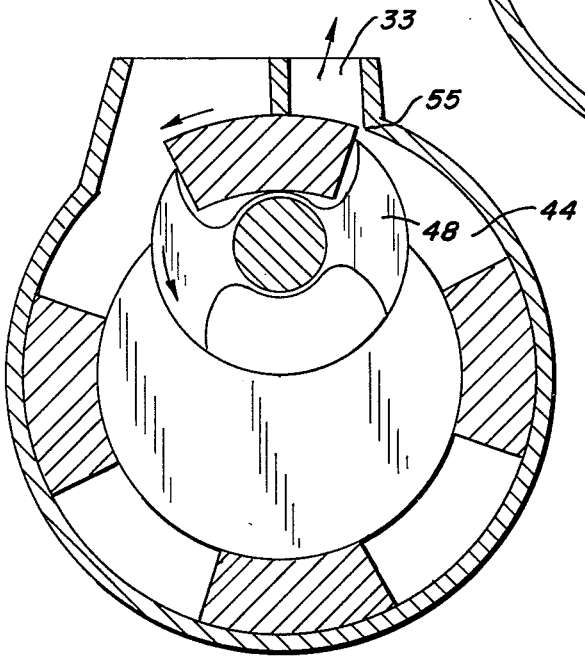

FIGS. 2–4 illustrate successive positions of the rotors in one cycle of compression. In FIG. 2, the leading edge of a rotor lobe 48 is about to enter a working chamber 44 of the cage rotor. In FIG. 3 the cage rotor has turned about 20° counterclockwise and lobe 48 has moved almost half way into working chamber 44. In FIG. 4, the rotors have turned a few degrees farther and the trailing edge of cage rotor tooth 43 is about to leave the wall of the outer housing 30 at the leading edge 55 of outlet port 33. The air trapped within working chamber 44 has been compressed by the entry of lobe 48 into the chamber with a consequent reduction in volume. Concurrently, the working chamber counterclockwise from the chamber approaching the outlet port is open to inlet port 32 and traps a body of air to be carried through the machine for subsequent compression.

The angular position of the leading edge 55 of outlet port 33 is a major factor in establishing the compression ratio of the machine. As viewed in FIGS. 1–4, if the edge 55 is moved in a clockwise direction the compression ratio is reduced while if it is moved in a counterclockwise direction, the compression ratio is increased.

Figure 5:
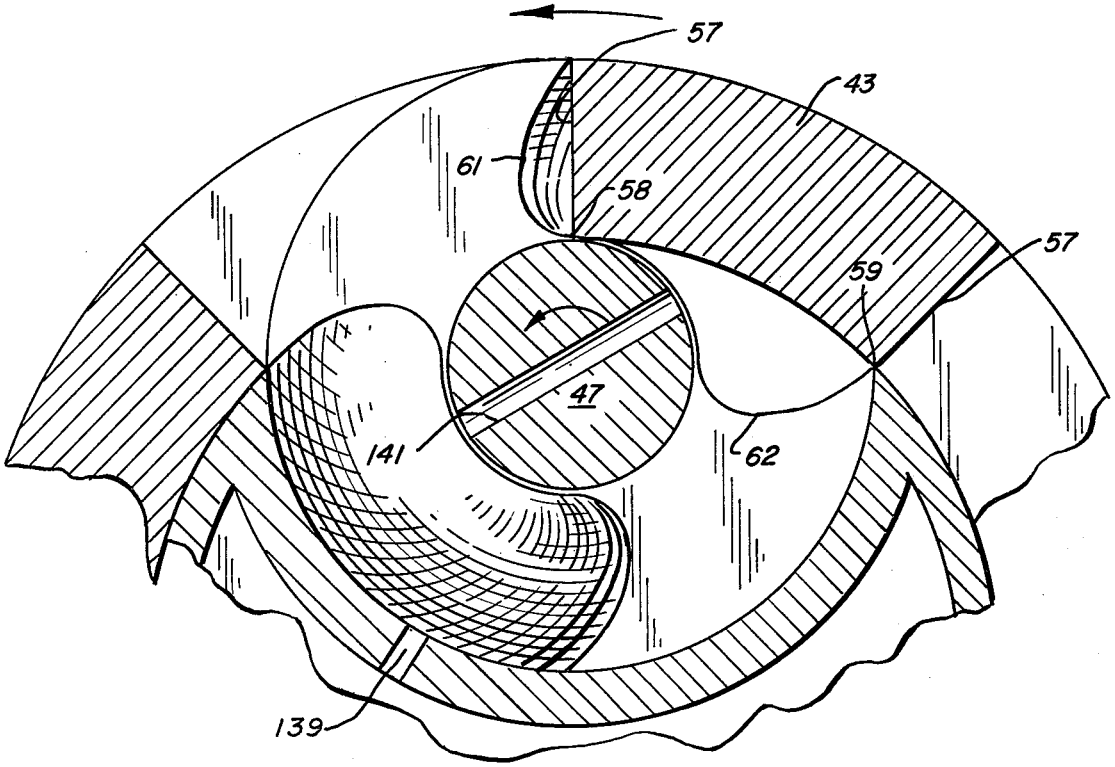
FIG. 5 is an enlarged fragmentary section through the lobe rotor and a portion of the cage rotor illustrating the profile of the lobe rotor flanks.

The 2:1 ratio of rotor diameters and speeds affords a particularly desirable combination of sealing surfaces between the rotors as illustrated in FIG. 5. The teeth or webs 43 of the cage rotor have sidewalls 57 which are radial with respect to the center of the cage rotor. This simplifies manufacture of the cage rotor. The radial thickness of the cage rotor web 43 is $$\frac{D}{2}\left(1 - \frac{\sqrt{2}}{2}\right)$$

where D is the diameter of the cage rotor.

The shape of the flanks of the lobes of the lobe rotor is determined by the motion of the lobes relative to the inner corners 58, 59 of web 43. The surfaces 61, 62 from the circular hub 47 to the periphery of the respective lobes are cycloids determined by the motion of the points 58, 59 along the lobe surface. The center hub 47 has a circular periphery joining the inner ends of the cycloidal flanks of the lobes. The center of the circular arc is the axis of rotation of the lobe rotor and its diameter is $$\frac{D}{2}(\sqrt{2} - 1).$$

The length of the circular arc between the inner ends of the cycloid flanks is $$\frac{D\pi}{4}(\sqrt{2} - 1).$$

Sealing between the cage and lobe rotors occurs only at the outer periphery of the lobe rotor. Accordingly, the geometry of the edge between the lobe rotor periphery and the flanks should correspond with the cycloids. The lobe rotor flanks between the periphery and the circular hub may depart from the cycloid providing greater clearance from the inner corners of the web of the cage rotor.

In a machine having working spaces and lobes which extend axially rather than helically, the lobe enters the working space along the length of the machine at one point in the rotation of the rotors. The entire length of the working space communicates with the discharge port at another angle. This results in a relatively low compression ratio and a pulsating output. The helical configuration of the rotor can provide higher compression ratios and can minimize pulsation.

Figure 6:
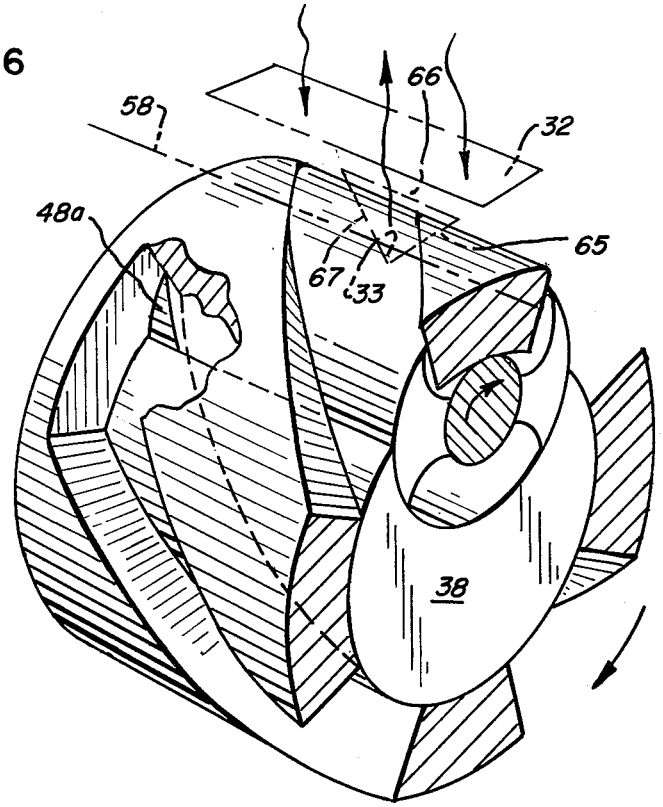
FIGS. 6, 7 and 8 are diagrammatic perspective view of the rotors illustrating a sequence of positions.
Figure 7:
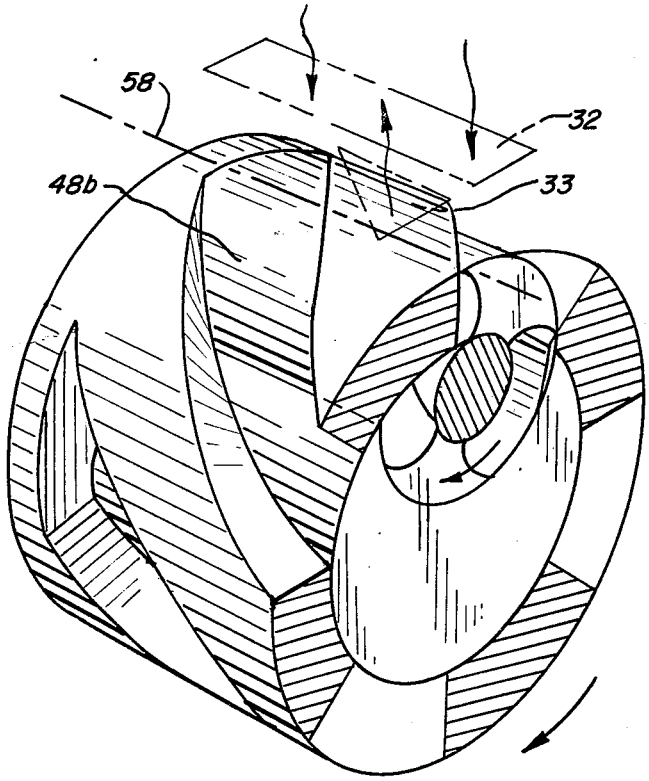
Figure 8:
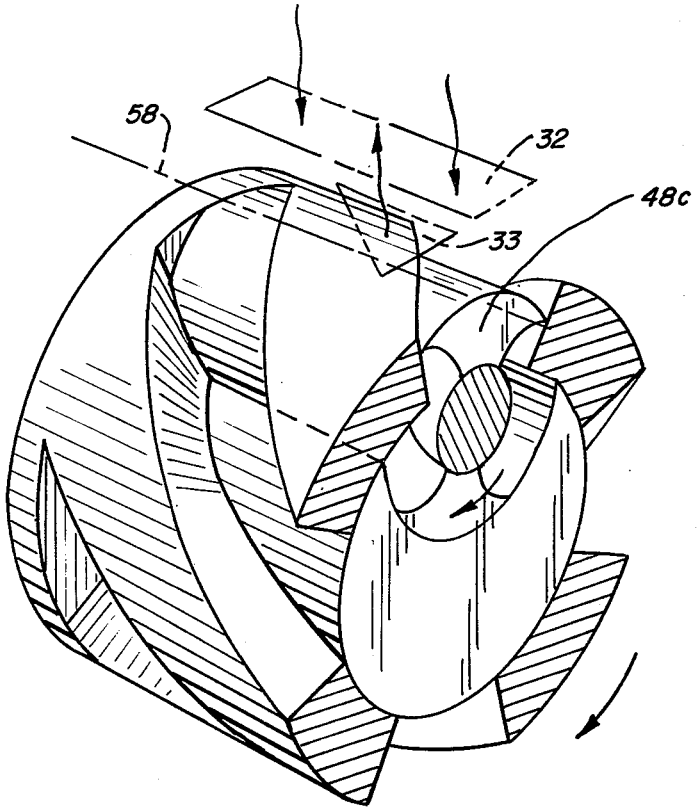

The relationship of the helical working spaces and rotor lobes to the ports is illustrated in the diagrammatic perspectives of FIGS. 6, 7 and 8. The rotors are illustrated looking from the rear of FIG. 1 and turn in a clockwise direction. Rotor lobe 48 first enters a working space at the low pressure end of the machine remote from outlet port 43. The leading edge 48*a* of a lobe of the lobe rotor is shown in this position in FIG. 6. FIG. 7 shows the parts rotated to a position where roughly half the lobe identified as 48*b*has entered the working space 44. In FIG. 8 the parts have turned further with the trailing edge 48*c* of the lobe extended into the working space 44. In FIGS. 6–8, the line 58 represents the tangent line between the outer peripheries of the rotors, along the housing wall 34 between inlet port 32 and outlet port 33. The intersection of the surface of the lobe 48 of the lobe rotor with the tangent line starts at the low pressure end of the machine and moves progressively toward the high pressure end compressing the gas trapped in the working space ahead of it, until the edge of the web which bounds the leading edge of the working space passes the leading edge 55 of the outlet port. At this point the compression action is completed and the compressed gas is discharged through the outlet port. As the working space rotates beyond the tangent line 58, rotor lobe 48 is withdrawn and the working space fills with air drawn through inlet 32.

Figure 27:
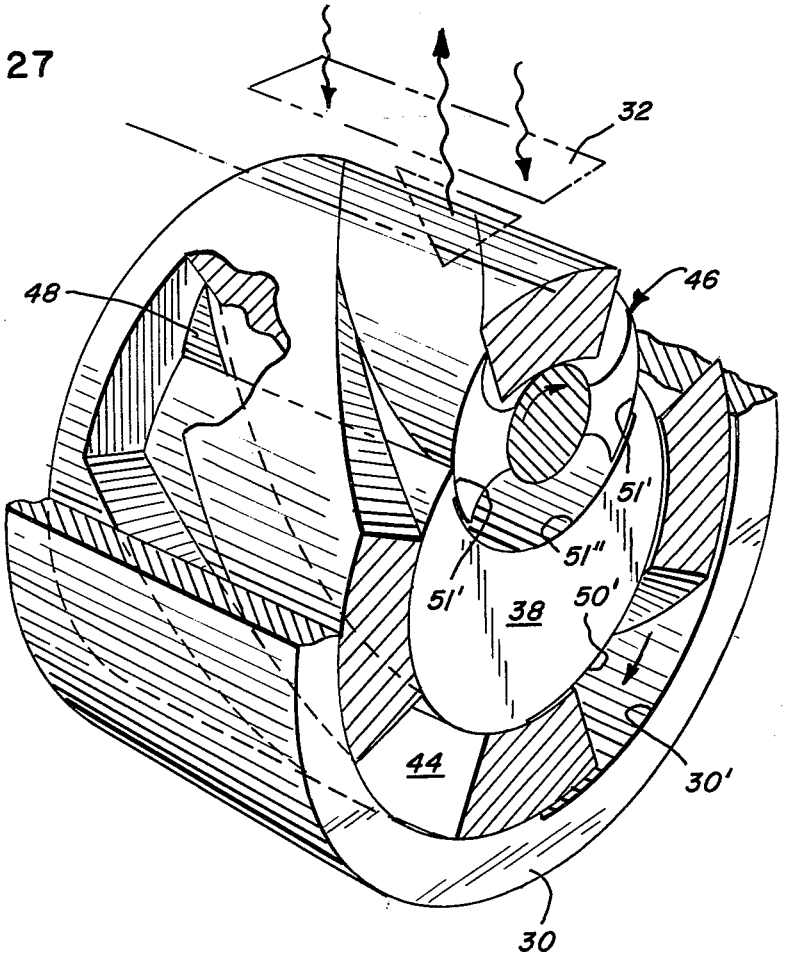
FIG. 27 is a view similar to FIG. 6, showing a portion of the outer housing and illustrating in exaggerated scale a machine with large tolerances between certain surfaces.

It is only necessary that the slots or working spaces 44 be sealed with the housing at and beyond the point of rotation at which the lobe 48 enters the slot. Close manufacturing tolerances are important only where a seal is required. Accordingly, both the inner surface 30' of outer housing member 30 and the outer surface 50' of inner housing member 38 may be relieved between the inlet 32 and the point at which the working space is located when the lobe 48 enters it as shown in FIG. 27. The amount of relief is exaggerated so that it can be seen. Inlet port 32 need not be adjacent outlet port 33, but may be closer to the point at which compression begins. Similarly, the lobe rotor may be sealed with the minor arc of the inner housing member along two axial zones 51' at the ends of the minor arc and the surface 51'' between these zones may be spaced from the periphery of the lobe rotor. Outlet port 33 preferably has the configuration of right triangle with one leg 65 in the transverse plane of the high pressure end of the working spaces 44 and the other leg 66 parallel with but spaced laterally ahead of the radial plane of the line of tangency 58. The hypotenuse 67 is parallel with the edge of cage rotor teeth 43 and corresponds with the leading edge 55 of the outlet opening, FIG. 4. As pointed out above, the position of the edge 55, 67 is a factor in establishing the compression ratio of the machine. Moreover, if the relative size of outlet port 33 and the distance between successive working spaces 44 is such that the outlet port overlaps two working spaces, pulsation of the compressed gas is minimized.

Figure 9:
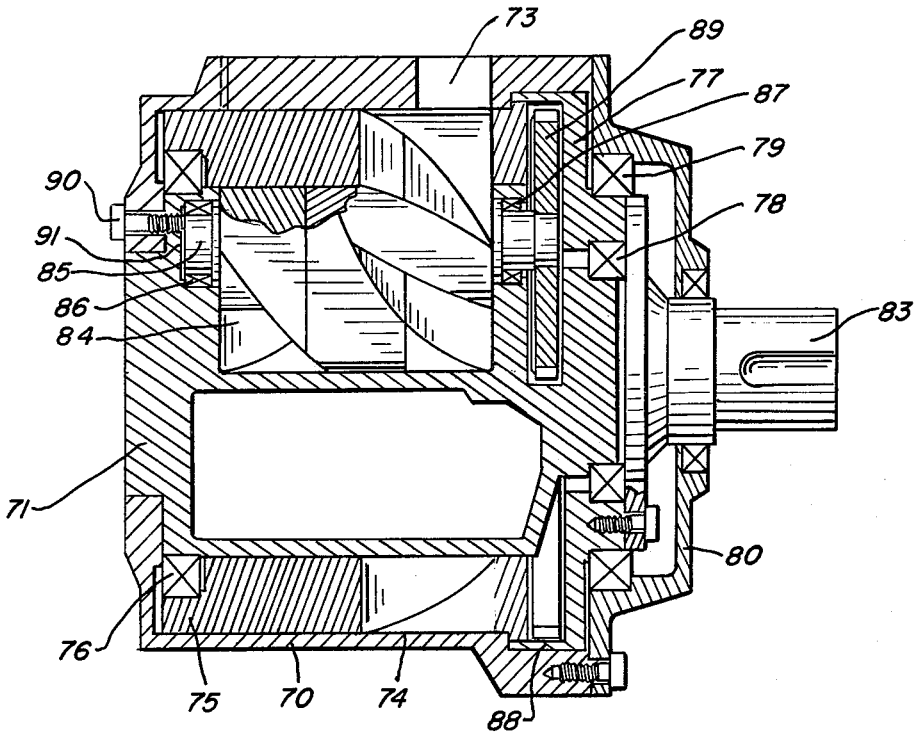
FIG. 9 is an axial section taken along line 9—9 of FIG. 10 showing a single stage machine with some elements illustrated diagrammatically.
Figure 10:
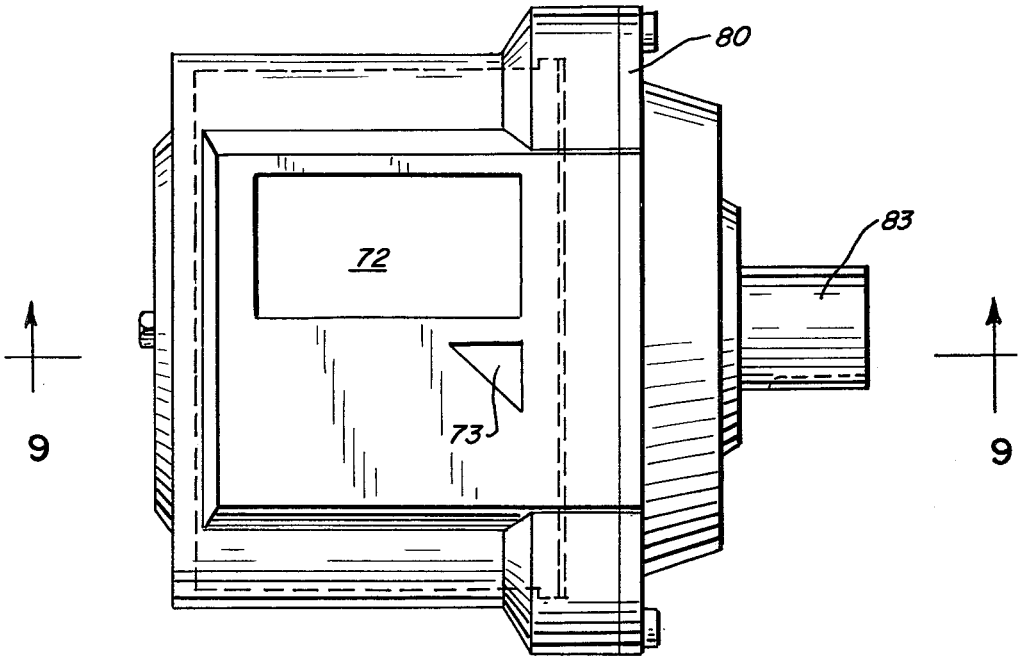
FIG. 10 is a top plan view of the machine of FIG. 9.

FIGS. 9 and 10 illustrate some of the mechanical features of a single stage compressor. Cylindrical outer housing member 70 has the crescent-shaped inner housing member 71 therein. Inlet port 72 and outlet port 73 are provided in the wall of the outer housing. Cage rotor 74 has end ring 75 at the low pressure end supported on a bearing 76 carried by the inner housing member 71. A rotor drive plate 77 is connected with sleeve rotor 74 at the high pressure end and is carried between bearing 78 mounted on the inner housing member 71 and bearing 79 held by cover plate 80 secured to outer housing member 70. Drive shaft 83 secured to plate 77 extends axially outwardly through the cover plate. Lobe rotor 84 has a shaft 85 mounted at the low pressure end on a bearing 86 and at the high pressure end by a bearing 87. A ring gear 88 on drive plate 77 engages a gear 89 on lobe rotor shaft 85 to drive the lobe rotor in synchronism with the cage rotor. Screw 90 acts on a thrust bearing 91 at the low pressure end of lobe rotor shaft 85 to establish the axial position of the lobe rotor and the clearance of the lobe end surfaces from the housing at the high pressure end of the machine. Clockwise rotation of shaft 83 (as viewed from the right in FIGS. 9 and 10) provides compression as discussed above.

Figure 11:
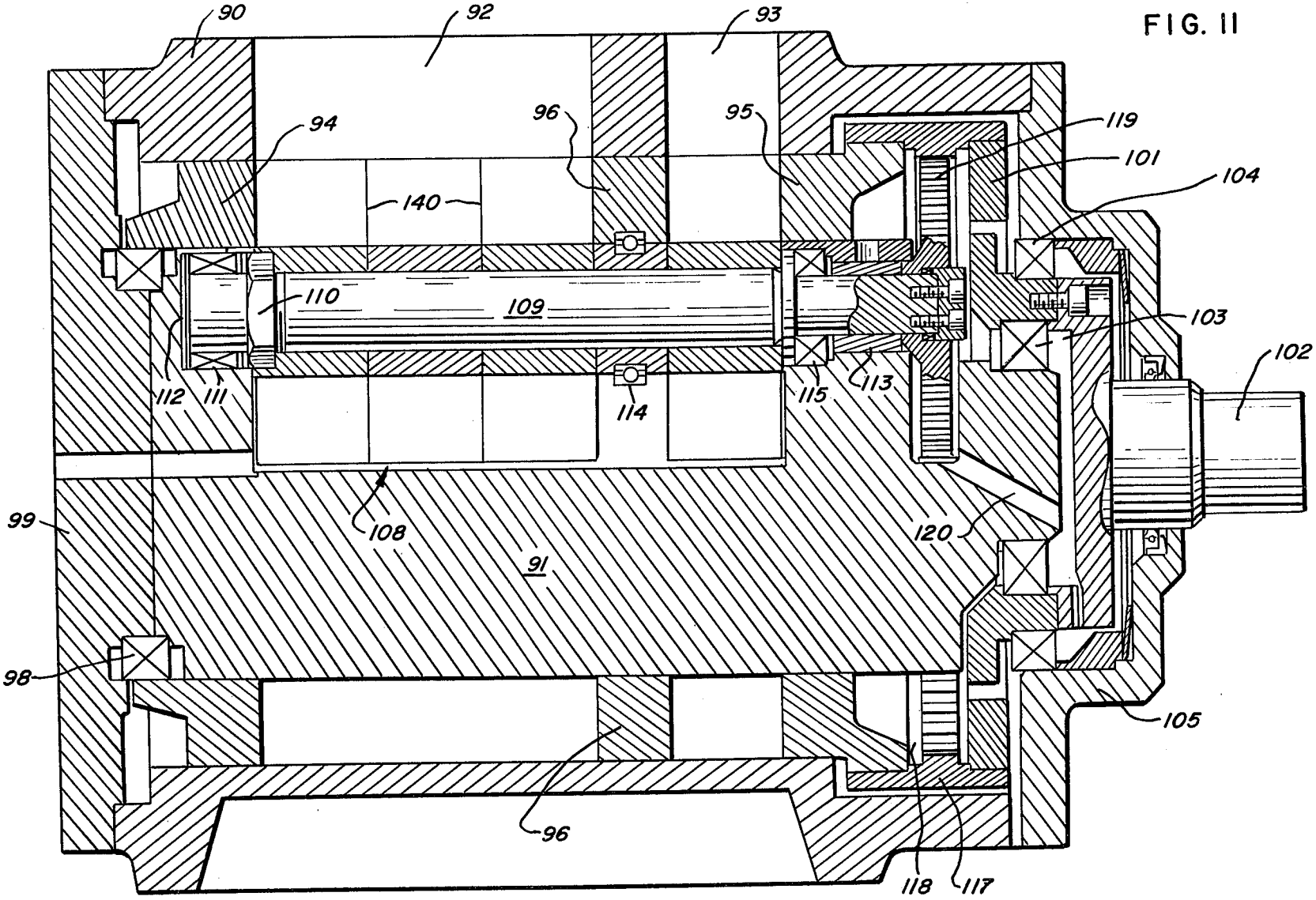
FIG. 11 is an axial section through a two stage compressor illustrating a preferred embodiment of the invention.

Additional mechanical details of a machine are illustrated by the two stage compressor utilizing one cage rotor and one lobe rotor, FIG. 11. The outer cylindrical housing 90 has a low pressure first stage at the left and a high pressure second stage at the right. Inner housing member 91 extends the length of the machine. Low and high pressure inlet ports 92, 93 are shown. In practice (as will appear below) the outlet port of the first stage is connected with the inlet port of the second stage preferably through a suitable capacity control valve. The cage rotor (details of the webs are omitted for clarity) has a low pressure end ring 94, a high pressure end ring 95 and an intermediate ring 96 dividing the two stages. Low pressure end ring 94 is carried by a bearing 98 mounted on end plate 99 and inner housing member 91. High pressure end ring 95 is connected with drive plate 101 and shaft 102. Drive plate 101, as in the single stage machine, is carried between bearings 103 and 104 on the inner housing member 91 and end plate 105, respectively.

Lobe rotor 108 is made up of a plurality of sections mounted on shaft 109, as will be discussed in more detail below. Again, the contours of the lobes are not illustrated for clarity. The sections of the lobe rotor are assembled on shaft 109 and held in place by a nut 110. Shaft 109 is supported by a bearing 111 at the low pressure end and held against excessive axial movement by thrust spring 112. The shaft is mounted by a bearing 113 at the high pressure end.

The lobe rotor 108 is axially positioned by a thrust bearing 114 carried by the intermediate ring 96 of the sleeve rotor. Alternatively, a thrust bearing 115 may be provided at the high pressure end of the shaft, carried by inner housing member 91. The intermediate thrust bearing 114 is preferred so that expansion of the lobe rotor at operating temperature is divided between the low pressure and high pressure sections.

Ring gear 117 between drive plate 101 and the sleeve rotor extends through an oil sump 118 at the bottom of the machine. As the gear turns, oil is carried up and delivered to lobe rotor drive gear 119. The oil drains through passage 120 to bearings 103, 104 and is returned to the sump.

In the machines of FIGS. 9 and 11, it is preferable that the pitch diameter of the rotor synchronizing gears is the same as the outside diameter of the cage rotor.

FIG. 12 illustrates an interconnection of the inlet and outlet port of the two stage compressor to provide for capacity control. Low pressure inlet 92 is open. Low pressure outlet 123 is closed by a cover plate and is connected through a passage 124 with high pressure or second stage inlet 93 which is closed. High pressure outlet 124 is connected with a suitable outlet pipe 125. Passages 126 in the cover plate connect each of the inlet and outlet ports with a valve 127 which can be manipulated to interconnect the ports as desired for capacity control or to vent the high pressure outlet for ease in starting the compressor.

FIG. 13 illustrates the incorporation of a sealing element 128 in the housing wall 34 along the tangent line between inlet 32 and outlet 33. The sealing element is held against the peripheral surface of sleeve rotor 40 as by springs 129. Moreover, the sealing element may be shifted axially, as by a screw 130 threaded into the end wall of the outer housing, to provide a bypass between the outlet port 33 and inlet port 32, affording capacity control. Sealing element 128 is preferably of the material with good "wear-in" qualities. As a soft bearing metal or a plastic, as Teflon.

In the event the injection of a liquid into the compressor is desirable, as to aid in sealing gaps between the rotors and the housing, for lubrication or for cooling, the compressor may be connected as shown in FIG. 14.

Mineral oil is often used to provide all three functions. In the system illustrated in FIG. 14, the outlet of the compressor is connected through conduit 133 with an oil separator chamber 134. Within the chamber the oil drops out and the compressed air is taken away to its point of use through conduit 135. Oil is delivered from the separator chamber, under pressure of the compressed air through conduit 136 to a manifold 137 on the wall of the outer housing of the compressor. A plurality of inlets 138 deliver the oil to the rotors at about the location where the lobes of the lobe rotor enter the working spaces 44 of the sleeve rotor.

In order to prevent the cooling liquid from leaking into the spaces between the webs 43 of the sleeve rotor and the lobe rotor, a sealing gas may be utilized as illustrated in FIG. 5. The sealing gas, at a pressure of the order of that of the compressor output, is introduced into the space between the lobe rotor and the minor arc of the inner housing member through a port 139 in the inner housing member. A passage 141 through the shaft of the lobe rotor provides communication for the sealing gas to the spaces between the flanks of the rotor and the walls of the sleeve rotor webs.

Figure 15:
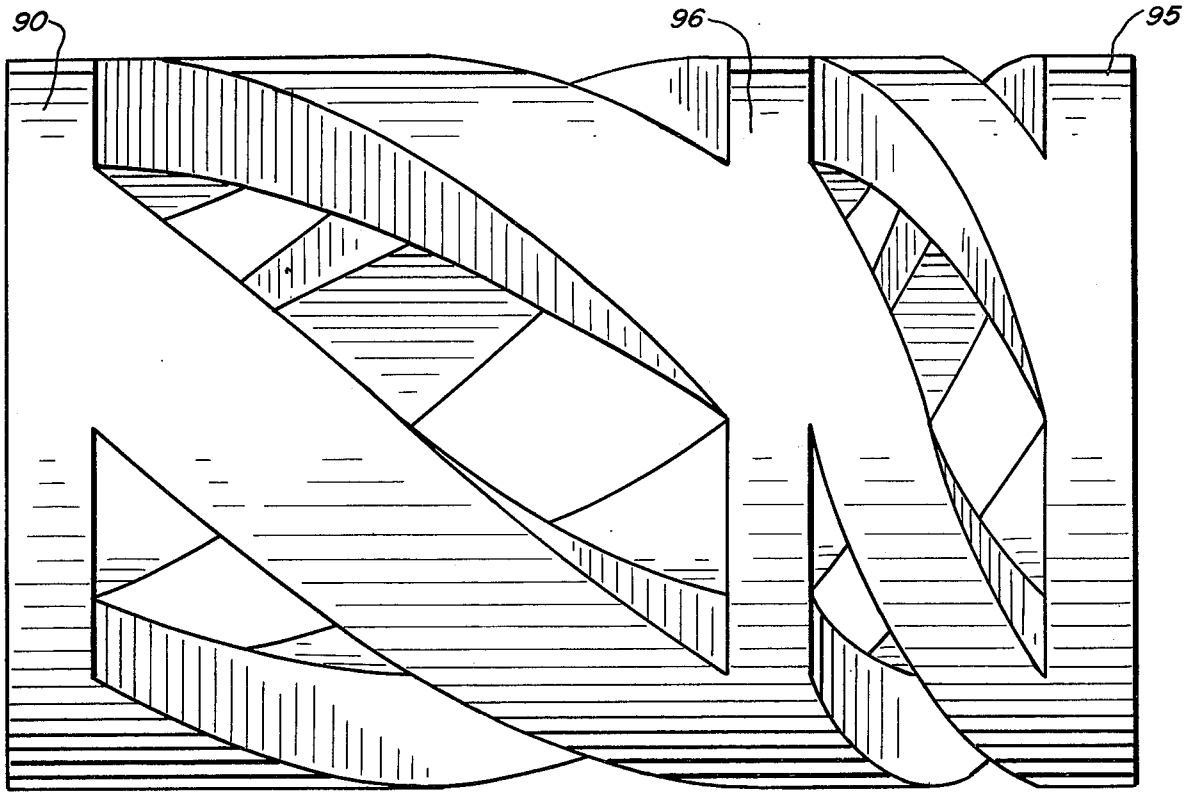
FIG. 15 is a side elevation of a two stage cage rotor.
Figure 16:
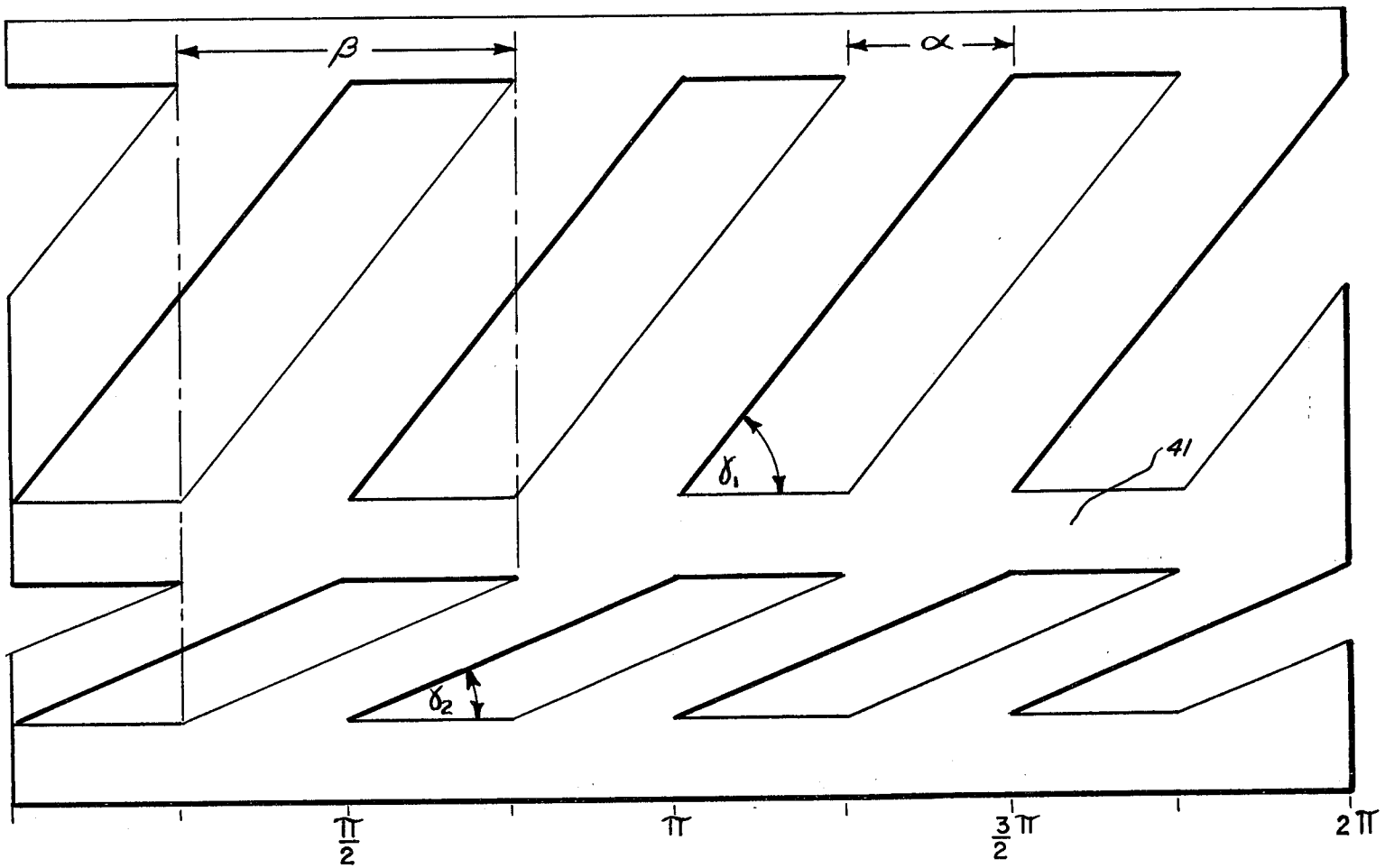
FIG. 16 is a diagram illustrating development of the cage rotor of FIG. 15.

FIGS. 15 and 16 show in elevational and in developed form a two stage cage rotor. The helix wrap angle $\beta$ is $\pi/2$. In the special case where the tooth width angle $\alpha$ is equal or larger than the wrap angle $\beta$ (not shown in FIG. 16), the lobe rotor can be inserted into the cage rotor as a single element. Where, however, the wrap angle $\beta$ is greater than the tooth width $\alpha$ as shown in FIG. 16, the lobe rotor must be made in elements which are inserted into the cage rotor and then assembled with the lobe rotor shaft. This sectional lobe rotor is illustrated by the diversion lines 140 in FIGS. 9 and 11.

If the axial dimension of the second compression stage is a fraction, e.g., one-third, the axial length of the first stage and if the web angles $\gamma_1$ and $\gamma_2$ for the two stages are made equal, the lobe rotor section for the second compression stage may be identical with one of the plural sections of the first stage. This permits economical manufacture of the lobe rotor.

Figure 17:
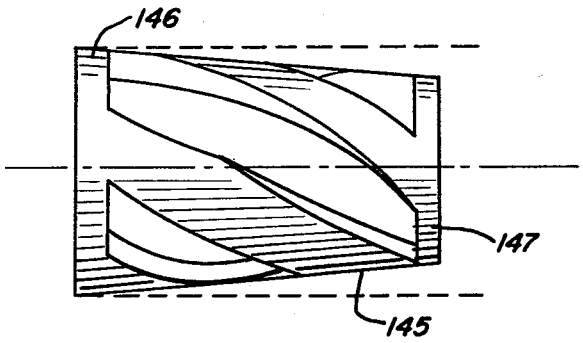
FIG. 17 is an exaggerated diagram illustrating a modified dimensional relationship in the cage rotor.

The temperature of a gas rises substantially during compression. As a result, the compressor may have a significant temperature differential between the low pressure end and the high pressure end. FIG. 17 illustrates in exaggerated form a cage rotor 145 which at ambient temperature, below the normal operating temperature, has a diameter at the low pressure end 146 greater than the diameter at the high pressure end 147. As a matter of the design of the outer housing member and the seals for efficient operation, it is desirable that the cage rotor have a uniform diameter. The difference in diameter of the ends is such that with the temperature differential experienced in operation the high pressure end expands to the same diameter as the low pressure end.

Figure 18:
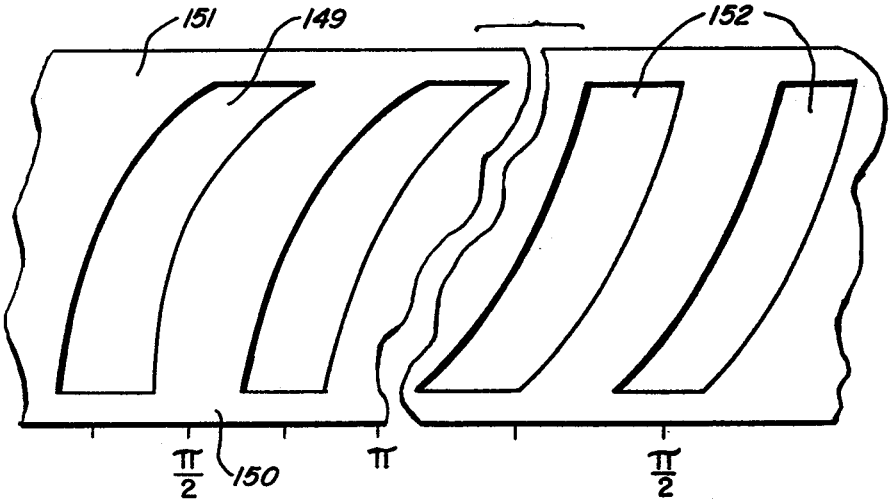
FIG. 18 is a diagram of the development of the cage rotor, similar to FIG. 16, illustrating wrap angles which increase and decrease from one end of the rotor to the other.

The compression ratio and other operating characteristics of the machine may further be controlled by having the angle $\gamma$ of the webs and working spaces differ from one end to the other of the sleeve rotor. FIG. 18 illustrates in developed form a cage rotor showing such a construction. Working spaces 149 have an angle which decreases from the low pressure end 150 to the high pressure end 151. Working spaces 1512 have an angle which increases. The lobes of the lobe rotor must, of course, have a corresponding variation in the lobe angle.

Figure 20:
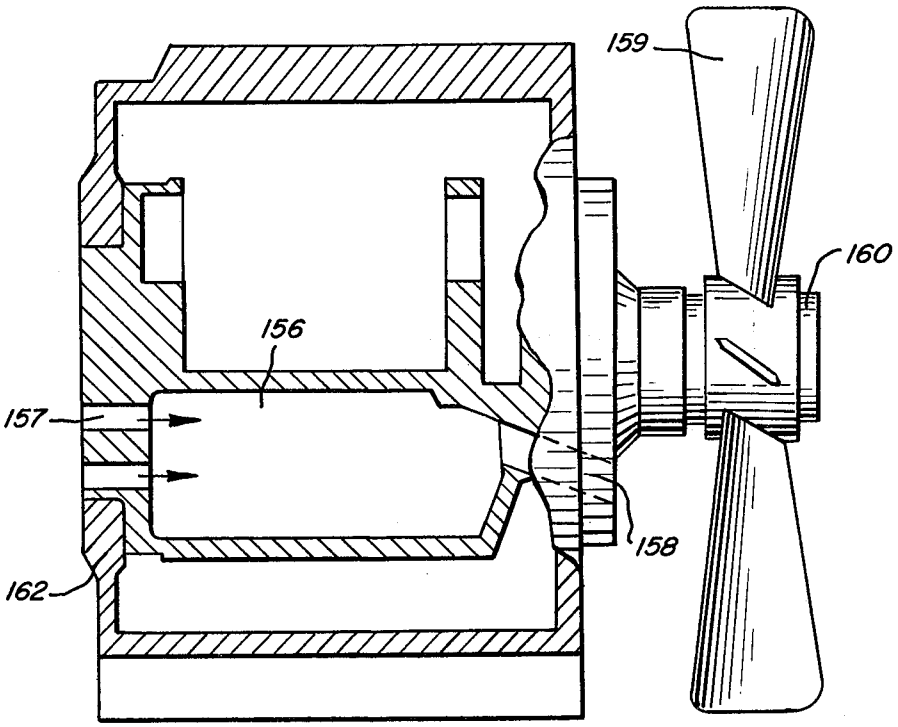
FIG. 20 is a longitudinal section through the machine of FIG. 19.
Figure 19:
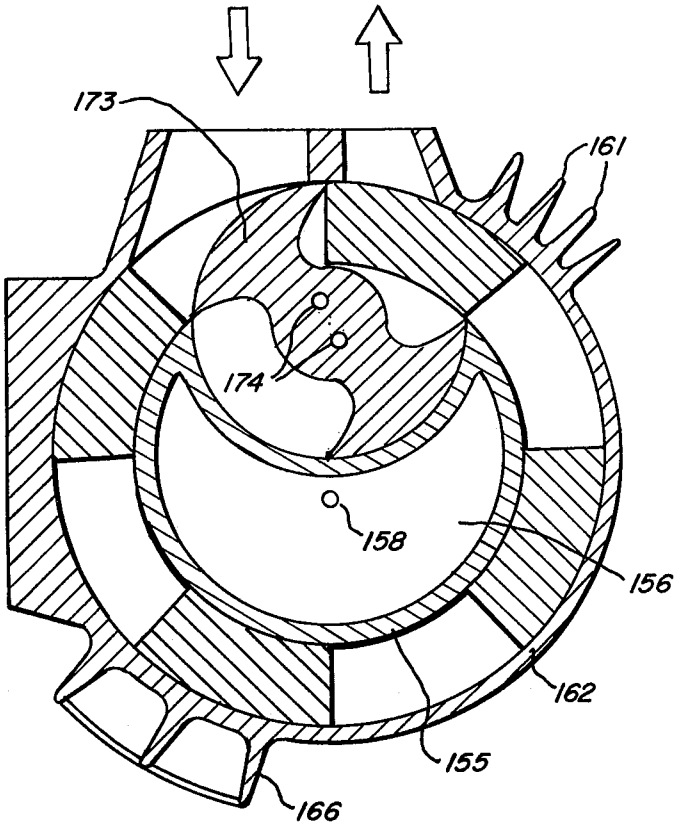
FIG. 19 is a transverse section through a machine illustrating cooling thereof.

FIGS. 19–22 illustrate compressors with provision for cooling by circulation of fluid through the compressor. In FIGS. 19 and 20, the crescent-shaped inner housing member 155 is hollow having an interior chamber 156. The chamber is provided with a pair of inlet ports 157 at the low pressure end of the machine and an exhaust port 158 at the high pressure end of the machine. A propeller 159 mounted on compressor drive shaft 160 sets up an air flow through the chamber 156 from left to right as viewed in FIG. 20.

Cooling fins 161 may be provided on outer housing member 162, at least adjacent the portion of the housing within which compression takes place and where much of the heat is generated.

Figure 21:
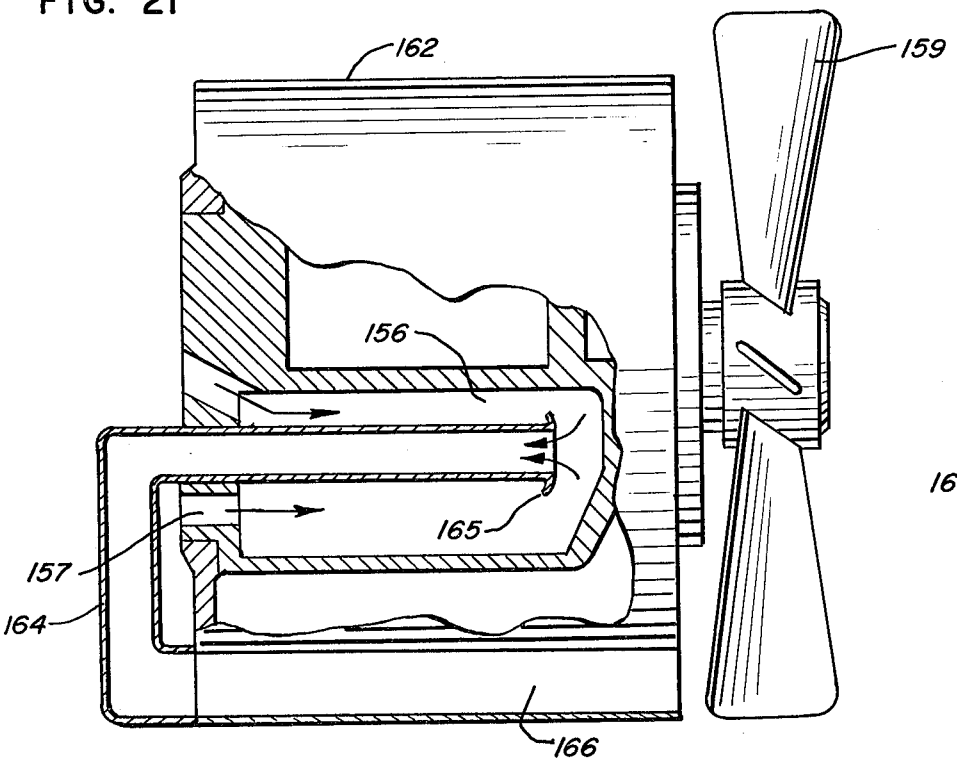
FIG. 21 is a side view with a portion broken away illustrating another form of cooling.

A modified cooling arrangement is shown in FIG. 21 where all of the ports are provided through the end wall of the outer housing at the low pressure end of the compressor. This avoids interference with the multiple bearings and synchronizing gearing at the high pressure end. The outlet port of FIG. 20 is replaced by an outlet tube 164 which extends through the low pressure end wall into the chamber 156 and has a flared rim 165 to enhance flow adjacent the high pressure end of the machine. The tube 164 extends along the outside of housing member 162, between cooling fins 166 to a point adjacent propeller 159. Again, air is drawn in through ports 157, circulates through chamber 156 and flows out through tube 164.

Figure 22:
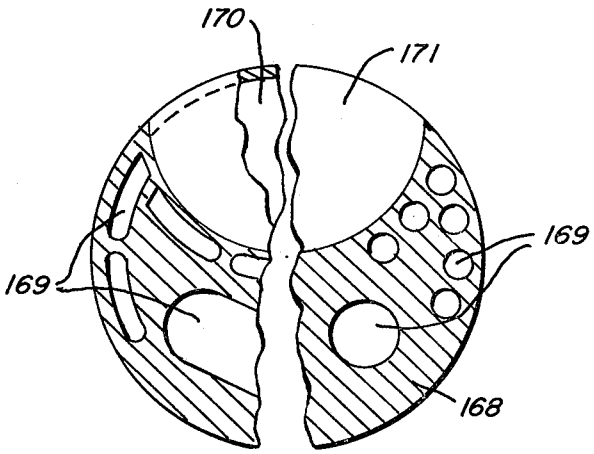
FIG. 22 is a fragmentary transverse section of a machine illustrating yet another form of cooling.

FIG. 22 illustrates in fragmentary form a crescent-shaped inner housing member 168 having a plurality of passages 169 extending axially therethrough for the circulation of a cooling gas or liquid. A manifold chamber 170 may connect the passages 169 in the front wall 171 of the machine. Lobe rotor 173, which is subjected to the highest temperatures in the machine, may be cooled by circulating liquid through passages 174. The passages may extend through a rotary joint (not shown) at the end wall of the machine.

Figure 23:
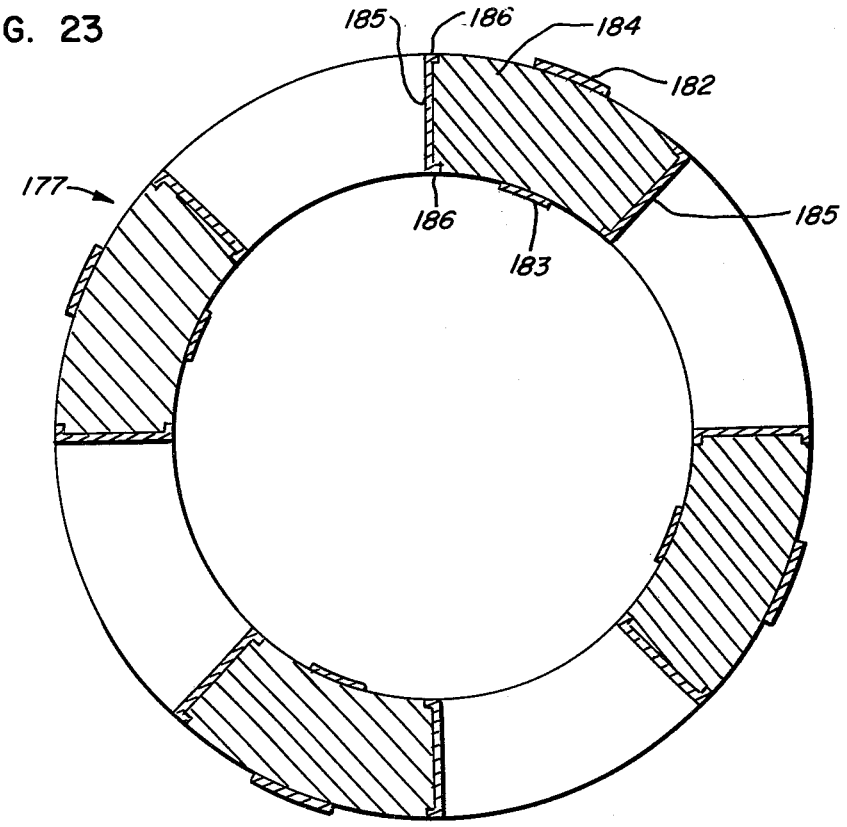
FIG. 23 is a transverse section of the cage rotor illustrating a coating of a sealing material on surfaces thereof.
Figure 24:
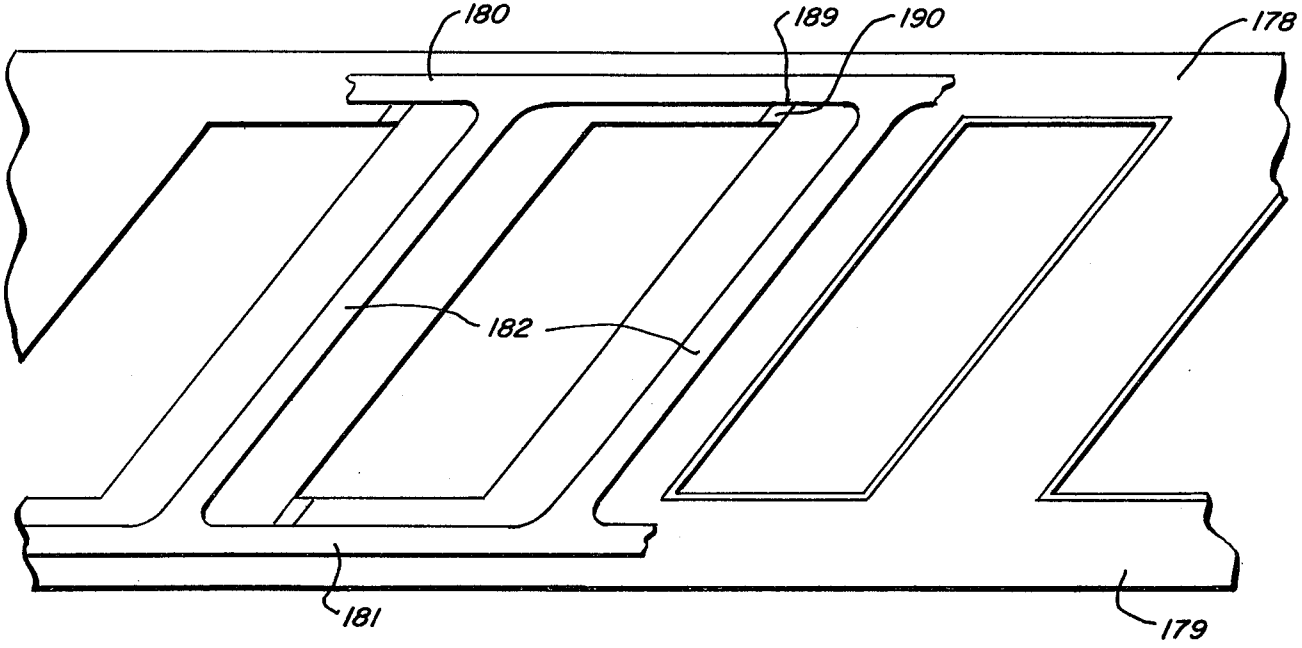
FIG. 24 is a fragmentary diagram of the development of the cage rotor illustrating the application of sealing material thereto.

The surfaces of the machine which bound the working chambers where gas is compressed are preferably provided with a coating of a sealing material which forms a reliable seal and which is capable of "running-in" without seizure or other damage to cooperating surfaces of the machine. Clearances between parts and manufacturing tolerances may be reduced without risking damage to the machine. FIGS. 23 and 24 illustrate the application of such sealing material to the surfaces of the cage rotor 177 which coact either with the lobe rotor or with the housing (not shown in FIGS. 23 and 24) to bound the slots within which gas is compressed. More particularly, the outer and inner peripheral surfaces of end rings 178, 179 are provided with an endless ring 180, 181 of sealing material. Further strips of sealing material 182, 183 extend axially along the outer and inner surfaces of webs 184. The lateral faces of the webs 184 have a coating 185 of sealing material which extends over the entire side face of each of the webs, the inner faces of the end rings and slightly overlaps the inner and outer peripheral surfaces of the webs and end rings surrounding the working spaces, as shown at 186.

Preferably the sealing material is a soft metal alloy, as shite metal, for example. Alternatively, a plastic with low friction characteristics, as Teflon, may be used.

It is desirable to achieve a good seal of the working spaces of the cage rotor that the corners be as sharp as possible. With the helical rotor configuration two opposite corners of each working space are defined by teeth and end rings forming an acute angle. Such angles are difficult to manufacture with a sharp intersection of the plane surfaces. Accordingly, these corners are overcut as indicated at 189 and the overcut recess is filled with sealing material 190 which may be formed to a sharp intersection with the adjacent wall.

Figure 25:
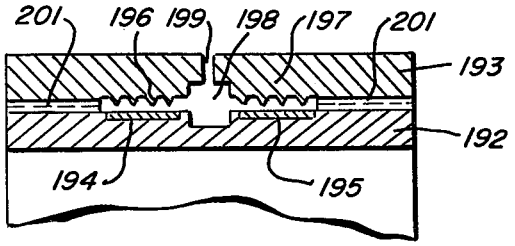
FIG. 25 is a fragmentary section showing a seal between the end ring of the cage rotor and the housing.

Another aspect of the sealing of the machine is illustrated in FIG. 25. Here, ring 192 is a part of the cage rotor and ring 193 is a part of the confronting surface of the compressor housing. Two spaced apart annular strips of sealing material 194, 195 are provided on the ring 192. Tooth-like ribs 196, 197 on the housing ring 193 bear on the sealing material rings 194, 195 and form a labyrinth seal therewith. A channel 198 between the labyrinth seal may be filled with water introduced through a port 199, providing a further seal for toxic gases. Return threads 201 are provided between rings 192 and 193 outside the labyrinth seals.

The thickness of the layers of sealing material is exaggerated in FIGS. 23–25. In practice, the coating on the side walls of the cage rotor webs 185 is preferably less than one-tenth of a millimeter. The coating of sealing material for the labyrinth seals is somewhat thicker. The coating material may be applied to the surfaces of the cage rotor as a strip of foil; or may be applied by electrodeposition or vapor diffusion, for example.

Figure 26:
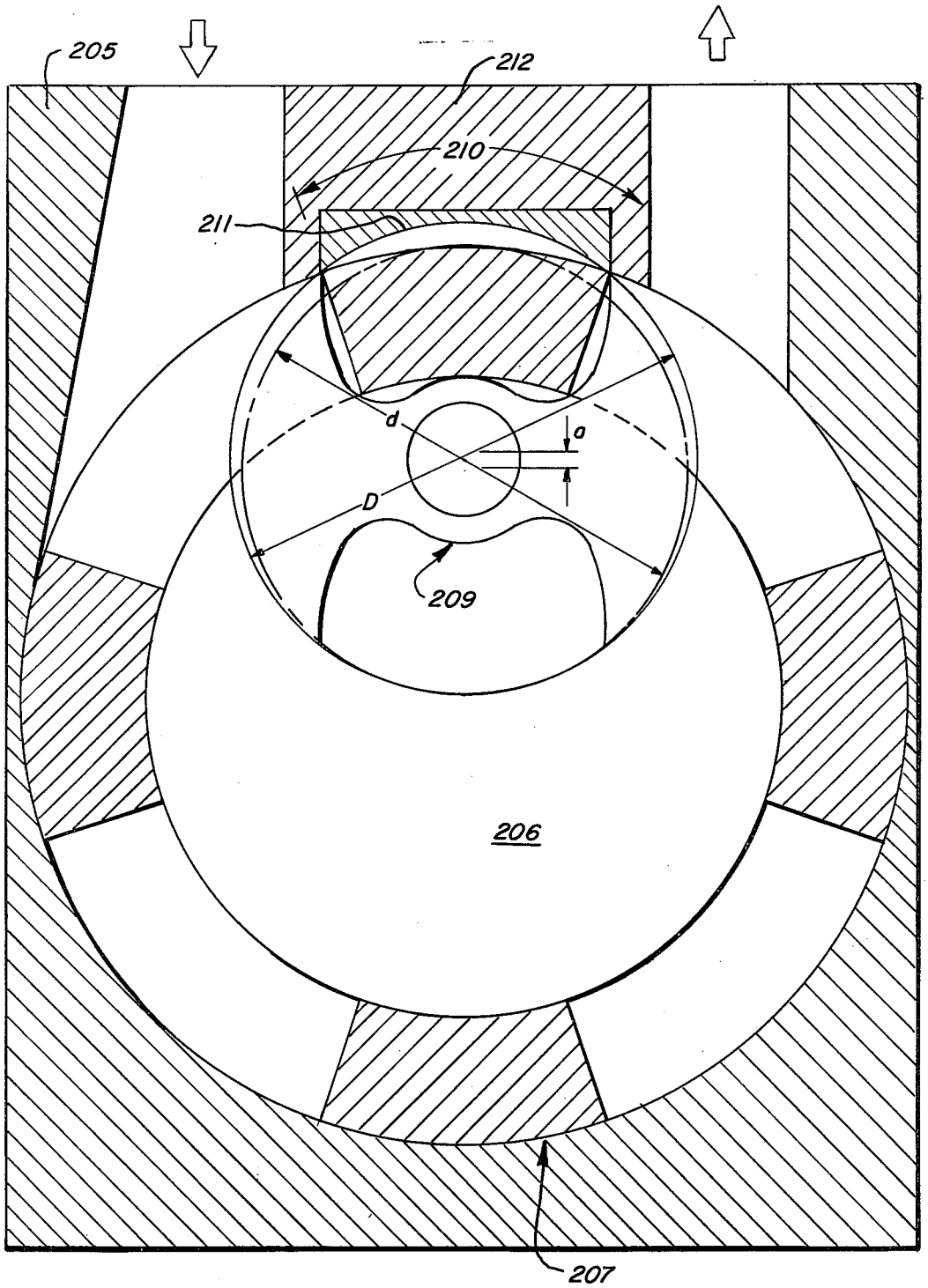
FIG. 26 is a fragmentary transverse sectional view illustrating a cage and lobe rotor which provide an extended peripheral seal in the zone of tangency.

With the peripheries of the cage and lobe rotors precisely tangent along the sealing line 58, FIGS. 6–8, a seal can be made with the periphery of the lobe rotor only along an axial line. While the sealing surface of the outer housing wall 34 can be extended peripherally to engage a greater surface area of the cage rotor, an adequate seal with the periphery of the lobe rotor is difficult to achieve. FIG. 26 illustrates in exaggerated form a modification of the compressor which enables the establishment of a better seal with the lobe rotor. Outer housing 205, inner housing 206 and cage rotor 207 may be the same as in the machines described above. Lobe rotor 209 is made larger than the lobe rotor which would have a periphery tangent with the periphery of cage rotor 207. Accordingly, the peripheries of the two rotors intersect in a zone centered on a radial plane of the cage rotor extending through a center of lobe rotor 209. The zone of intersection is identified by the arc 210. Within this arc sealing element 211 carried by outer housing wall 212 seals with the periphery of the lobe rotor 209. The sealing element is extended beyond the arc 210 to afford a seal with the periphery of cage rotor 207.

Merely increasing at the diameter of lobe rotor 209 from the diameter $d$ to diameter D achieves the desired improvement in peripheral seal. However, it results in an increased gap between the side walls of the cage rotor webs and the sealing edges of the lobe rotor. This increase in the tooth gap is minimized by offsetting the lobe rotor axis outwardly a distance $a$ which is equal to one-half the increase in lobe rotor diameter (D—d). Thus, the path of the periphery of the lobe rotor remains at the center of the cage rotor.

I claim:

1. A rotary gas machine operating with a change of volume and pressure of gas, comprising:

an outer cylindrical housing with a low pressure port and a high pressure port extending through the housing wall and adjacent, but circumferentially spaced apart, therein;

a cage rotor rotatable inside said housing and including a cylindrical sleeve having a plurality of alternate longitudinally extending helical teeth and slots, adjacent teeth having side wall surfaces which are radial with respect to the center of the cage rotor and define a slot therebetween, each of said slots communicating successively with said ports as the sleeve rotates;

a lobe rotor rotatable inside and in synchronism with said cage rotor with the rotational axes of the two rotors being parallel, the lobe rotor having a plurality of helical lobes which mesh with the helical slots of the cage rotor as the rotors turn, each of said lobes having oppositely disposed lateral peripheral edges which seal with the corresponding side wall surfaces defining the slot with which it meshes, the outer peripheries of the rotors being substantially tangent along a line parallel with the rotor axes and lying between said ports;

a first gear connected to said cage rotor;

a second gear connected to said lobe rotor and engaged with said first gear, said gears synchronizing rotation of the rotors; and a crescent-shaped inner housing member between the cage and lobe rotors diametrically opposite said tangent line, the crest of the helical lobe of the lobe rotor effectively moving axially along the cooperating slot of the cage rotor as the lobe and slot mesh along said tangent line to vary the slot volume between a maximum with the slot in communication with the low pressure port and a minimum with the slot in communication with the high pressure port.

2. The rotary gas machine of claim 1 in which compressed gas is delivered to said high pressure port and expands within the slots of the cage rotor, to cause rotation of the rotors.

3. The rotary gas machine of claim 1 in which the width of the teeth of the cage rotor is equal to the width of the slots.

4. The rotary gas machine of claim 1 wherein said first gear is a ring gear and said second gear is a spur gear and further including bearings for said rotors, a sump for lubricating oil, said ring gear extending into said sump, said machine having means, including said ring gear, for delivering oil from said sump to the rotor bearings.

5. The rotary gas machine of claim 1 in which the wrap angle $\beta$ of the helical slots and teeth of the sleeve rotor is less than or equal to the tooth angle $\alpha$ and the lobe rotor is fabricated as a single element.

6. The rotary gas machine of claim 1 including means for injecting a cooling liquid into the space between the outer housing and the inner housing member.

7. The rotary gas machine of claim 1 in which the rotors are driven and gas is drawn in at the low pressure intake port, compressed and discharged at the high pressure outlet port.

8. The rotary gas compressor of claim 7 including a sealing element between the outer housing and the rotors along said tangent line, and means for axially moving the sealing element providing a bypass from the high pressure port to the low pressure port.

9. The rotary gas compressor of claim 7 including means for injecting a cooling liquid into the space between the outer housing and the inner housing member, along the line where the lobes of the lobe rotor enter the slots of the cage rotor.

10. The rotary gas compressor of claim 7 including a drain passage through the housing to the space between the lobe rotor and the crescent-shaped inner housing member.

11. The rotary gas compressor of claim 7 in which the lobe rotor and the crescent-shaped inner housing member are sealed along two zones at the ends of the minor arc of the crescent and the surface of the crescent between said zones is spaced from the lobe rotor.

12. The rotary gas compressor of claim 7 in which the complementary outer peripheral surface of the cage rotor and inner surface of the outer cylindrical housing are sealed throughout the peripheral zone in which gas in said slots is compressed, and the housing surface is spaced from the cage rotor surface throughout the remainder of the periphery thereof.

13. The rotary gas compressor of claim 7 in which the complementary inner peripheral surfaces of the cage rotor and major arc of the crescent-shaped inner housing member are sealed throughout the peripheral zone in which gas in said slots is compressed and the crescent member surface is spaced from the inner periphery of the cage rotor throughout the remainder of the extent thereof.

14. The rotary gas compressor of claim 7 in which the high pressure end of the cage rotor has at a temperature less than operating temperature an outer dimension which is less than the outer diameter of the low pressure end of the cage rotor, whereby the two ends have substantially the same dimension at operating temperature.

15. The rotary gas compressor of claim 7 having two compression stages in which the cage rotor has two axially spaced sets of teeth and slots and the lobe rotor has two axially spaced sets of lobes which mesh with the slots of the cage rotors, said housing has a low pressure port and a high pressure port for each set of rotor parts, and including a fluid conduit connecting the high pressure port for the first stage with the low pressure port for the second stage.

16. The two stage rotary gas compressor of claim 15 in which said cage rotor has an annular ring between the two sets of teeth and slots, and including a lobe rotor thrust bearing between the lobe rotor and the ring of the cage rotor.

17. The two stage rotary gas compressor of claim 15 including a bypass valve connected between the high pressure port of the second stage and the low pressure port of the first stage.

18. The two stage rotary gas compressor of claim 17 in which said bypass valve is connected between the high pressure ports of both stages and the low pressure port of the first stage.

19. The two stage rotary gas compressor of claim 15 in which the tooth angle of the cage rotor is the same in both stages.

20. The two stage rotary gas compressor of claim 19 in which the axial length of the first stage is an integral multiple of the axial length of the second stage and the lobe rotor of the first stage is assembled from a plurality of sections identical with the lobe rotor of the second stage.

21. The rotary gas compressor of claim 7 including a thrust bearing fixing the axial position of the lobe rotor in the housing, at a point spaced from the low pressure end of the lobe rotor, and a spring at the low pressure end of the lobe rotor, urging the lobe rotor toward the thrust bearing.

22. The rotary gas compressor of claim 21 in which the lobe rotor thrust bearing is at the end thereof opposite the spring.

23. The rotary gas compressor of claim 21 in which said thrust bearing is at an intermediate point of the lobe rotor.

24. The rotary gas machine of claim 1 with a sealing element between the outer housing and the rotors along said tangent line.

25. The rotary gas machine of claim 24 in which said sealing element is spring biased against the periphery of the rotors along said tangent line.

26. The rotary gas machine of claim 1 in which the high pressure port is located at the end of the cylindrical side wall of the housing where the meshed lobe minimizes slot volume.

27. The rotary gas machine of claim 26 in which said high pressure port has an edge remote from the tangent line which is parallel with the edge of the cage rotor slot.

28. The rotary gas machine of claim 27 in which the high pressure port has the cross sectional configuration of a right triangle with said remote edge defining the hypotenuse and two edges defining the legs of the triangle, one edge being parallel with and adjacent the tangent line and the other edge being at right angles thereto.

29. The rotary gas machine of claim 1 in which the diameter of the cage rotor is twice the diameter of the lobe rotor and the lobe rotor has half as many lobes as the cage rotor has slots.

30. The rotary gas machine of claim 29 in which the cage rotor has four teeth and four slots, each with an angular width of ($\pi/4$) and a wrap angle of ($\pi/2$), and the angle of teeth and slots with respect to a plane at right angles to the rotor axis is of the order of 45°, and the lobe rotor diameter is one-half the diameter of the cage rotor, the lobe rotor having two lobes and a rotational speed twice that of the cage rotor.

31. The rotary gas machine of claim 29 in which the lobes of the lobe rotor have edges which seal with the side wall surfaces of the teeth of the cage rotor, said lobes having the relieved flank surfaces radially inward of the edges, with respect to the center of the lobe rotor, to avoid interference with the teeth of the cage rotor.

32. The rotary gas machine of claim 31 in which the flanks of the lobes of the lobe rotor have a surface configuration defined by a cycloid and the lobe rotor has a center hub with a circular periphery joining the cycloid at either side thereof.

33. The rotary gas machine of claim 32 in which the cage rotor teeth have a radial wall thickness T where:

$$T = \frac{D}{2}\left(1 - \frac{\sqrt{2}}{2}\right)$$

and D is the diameter of the cage rotor, the inner periphery of the cage rotor being tangent to the hub of the lobe rotor.

34. The rotary gas machine of claim 1 including a thrust bearing for said lobe rotor, fixing the lobe rotor axially in position.

35. The rotary gas machine of claim 34 in which said lobe rotor thrust bearing is mounted in said housing.

36. The rotary gas machine of claim 34 in which said lobe rotor thrust bearing is fixed with respect to said cage rotor.

37. The rotary gas machine of claim 1 in which the peripheral wrap angle $\beta$ of the helical slots and teeth of the sleeve rotor is greater than the tooth angle $\alpha$, and the lobe rotor is fabricated from a plurality of axially divided sections.

38. The rotary gas machine of claim 37 in which there is a bore through the multiple sections of the lobe rotor and a shaft extends through the bore.

39. The rotary gas machine of claim 1 in which the wrap angle of the helical spaces and lobes changes from the low pressure end of the machine to the high pressure end.

40. The rotary gas machine of claim 39 in which the wrap angle increases from the low pressure end of the machine to the high pressure end thereof.

41. The rotary gas machine of claim 39 in which the wrap angle decreases from the low pressure end of the machine to the high pressure end thereof.

42. The rotary gas machine of claim 1 wherein said first gear is a ring gear and said second gear is a spur gear.

43. The rotary gas machine of claim 42 further including means formed about the circumference of said cage rotor at one end thereof for engaging said ring gear, a drive shaft, and means fixed to said drive shaft for engaging said ring gear, whereby said drive shaft drives said rotors in unison.

44. The rotary gas machine of claim 43 in which said drive shaft is coaxial with said cage rotor and said drive shaft engaging means is connected to said ring gear such that relative rotational movement therebetween is prevented.

45. The rotary gas machine of claim 44 in which said ring gear is coaxial with and connected to said cage rotor such that relative rotational movement therebetween is prevented.

46. A rotary gas machine operating with a change of volume and pressure of gas, comprising:

an outer cylindrical housing with a low pressure port and a high pressure port extending through the housing wall and adjacent, but circumferentially spaced apart, therein;

a cage rotor rotatable inside said housing and including a cylindrical sleeve having a series of four alternate longitudinally extending helical teeth and slots, adjacent teeth having side wall surface which are radial with respect to the center of the cage rotor and define a slot therebetween, each of said slots communicating successively with said ports as the sleeve rotates, the wrap angle of the teeth and slots being substantially $\pi/4$;

a lobe rotor rotatable inside and in synchronism with said cage rotor with the rotational axes of the two rotors being parallel, the lobe rotor having two helical lobes which mesh with the helical slots of the cage rotor as the rotors turn, each of said lobes having oppositely disposed lateral peripheral edges which seal with the corresponding side wall surfaces defining the slot with which it meshes, the wrap angle of the lobes of the lobe rotor being substantially $\pi/2$, the outer peripheries of the rotors being substantially tangent along a line parallel with the rotor axes and lying between said ports; and a crescent-shaped inner housing member between the cage and lobe rotors diametrically opposite said tangent line, the crest of the helical lobe of the lobe rotor effectively moving axially along the cooperating slot of the cage rotor as the lobe and slot mesh along said tangent line to vary the slot volume between a maximum with the slot in communication with the low pressure port and a minimum with the slot in communication with the high pressure port, said high pressure port having a circumferential width substantially equal to the peripheral circumferential width of the cage rotor teeth, whereby there is substantially uniform continuous flow from the cage rotor slots through the high pressure port when the rotary gas machine is operated as a compressor.

47. A rotary gas machine operating with a change of volume and pressure of gas, comprising:

an outer cylindrical housing with a low pressure port and a high pressure port extending through the housing wall and adjacent, but circumferentially spaced apart, therein;

a cage rotor rotatable inside said housing and including a cylindrical sleeve having a plurality of alternate longitudinally extending helical teeth and slots, adjacent teeth having side wall surfaces which are radial with respect to the center of the cage rotor and define a slot therebetween, each of said slots communicating successively with said ports as the sleeve rotates;

a lobe rotor rotatable inside and in synchronism with said cage rotor with the rotational axes of the two rotors being parallel, the lobe rotor having a plurality of helical lobes which mesh with the helical slots of the cage rotor as the rotors turn, the lobes of the lobe rotor having lateral peripheral edges which seal with the side wall surfaces of the cage rotor teeth and relieved flank surfaces inward of the edges, the outer peripheries of the rotors being substantially tangent along a line parallel with the rotor axes and lying between said ports, the diameter of the cage rotor being twice the diameter of the lobe rotor which has half as many lobes as the cage rotor has slots; and a crescent-shaped inner housing member between the cage and lobe rotors diametrically opposite said tangent line, the crest of the helical lobe of the lobe rotor effectively moving axially along the cooperating slot of the cage rotor as the lobe and slot mesh along said tangent line to vary the slot volume between a maximum with the slot in communication with the low pressure port and a minimum with the slot in communication with the high pressure port.

48. The rotary gas machine of claim 47 in which the circumferential extent of the cage rotor teeth and the cage rotor slots in substantially equal.

49. The rotary gas machine of claim 48 in which the wrap angle of the cage rotor teeth and slots is $\pi/4$ and the wrap angle of the lobe rotor lobes is $\pi/2$.

50. The rotary gas machine of claim 49 in which there are four cage rotor teeth, four cage rotor slots, and two lobe rotor lobes.

51. The rotary gas machine of claim 47 in which the flank surfaces of the lobe rotor lobes are defined by cycloids.

52. The rotary gas machine of claim 51 in which said lobe rotor has a center hub with a circular periphery joining the cycloid at either side thereof and said hub is tangent to the inner periphery of said cage rotor.

53. A rotary gas machine operating with a change of volume and pressure of gas, comprising:

an outer cylindrical housing generally defined by a cylindrical side wall and oppositely disposed end plates with a low pressure port and a high pressure port extending through the side wall and adjacent, but circumferentially spaced apart, therein;

a cage rotor rotatable inside said housing and including a cylindrical sleeve having a plurality of alternate longitudinally extending helical teeth and slots, adjacent teeth having side wall surfaces which are radial with respect to the center of the cage rotor and define a slot therebetween, each of said slots communicating successively with said ports as the sleeve rotates;

a lobe rotor rotatable inside and in synchronism with said cage rotor with the rotational axes of the two rotors being parallel, the lobe motor having a plurality of helical lobes which mesh with the helical slots of the cage rotor as the rotors turn, each of said lobes having oppositely disposed lateral peripheral edges which seal with the corresponding side wall surfaces defining the slot with which it meshes, the outer peripheries of the rotors being substantially tangent along a line parallel with the rotor axes and lying between said ports; and a crescent-shaped inner housing member between the cage and lobe rotors diametrically opposite said tangent line, the crest of the helical lobe of the lobe rotor effectively moving axially along the cooperating slot of the cage rotor as the lobe and slot mesh along said tangent line to vary the slot volume between a maximum with the slot in communication with the low pressure port and a minimum with the slot in communication with the high pressure port, the low pressure port extending axially along the cylindrical side wall of the housing to span the axial length of the cage rotor slots, the high pressure port being located adjacent the axial end of the cylindrical side wall of the housing where the meshed lobe minimizes slot volume, whereby one portion of a slot positioned across said tangent line communicates with said low pressure port and another portion sealed from the one portion by a lobe of said lobe rotor communicates with said high pressure port.

54. The rotary gas machine of claim 53 in which said high pressure port has a triangular configuration with a first edge remote from said tangent line parallel with the circumferential edge of the cage rotor slots, a second edge intermediate said tangent line and said second edge parallel to said tangent line, and a third edge connecting said first and second edges parallel to the axial edge of the cage rotor slots where volume is minimized by said lobe rotor.

55. The rotary gas machine of claim 54 in which said third edge overlies the axial edge of the cage rotor slots.

56. The rotary gas machine of claim 55 wherein said third edge has a length substantially equal to the peripheral circumferential widith of the cage rotor teeth.

57. The rotary gas machine of claim 55 in which said third edge has a length greater than the peripheral circumferential width of the cage rotor teeth.

58. The rotary gas machine of claim 55 in which said third edge has a length less than the peripheral width of the cage rotor teeth.

59. The rotary gas machine of claim 55 in which said second edge is adjacent said tangent line.

60. The rotary gas machine of claim 55 in which the cage rotor slots are spaced from the opposite axial ends thereof and the lobe rotor lobes are also spaced from the axial ends of the cage rotor.

* * * * *